US007735541B2

(12) United States Patent
Ocampo

(10) Patent No.: US 7,735,541 B2
(45) Date of Patent: Jun. 15, 2010

(54) SHEET MATERIAL TENSIONING APPARATUS

(75) Inventor: Horacio Ocampo, Pacific Palisades, CA (US)

(73) Assignee: Lucius Hudson, Inc., Gardena, CA (US)

( * ) Notice: Subject to any disclaimer, the term of this patent is extended or adjusted under 35 U.S.C. 154(b) by 398 days.

(21) Appl. No.: 11/892,989

(22) Filed: Aug. 29, 2007

(65) Prior Publication Data

US 2009/0057364 A1 Mar. 5, 2009

(51) Int. Cl.
*A47G 5/00* (2006.01)

(52) U.S. Cl. ..... 160/374; 160/374.1; 160/375; 160/381; 40/482; 40/739; 101/127.1; 38/102

(58) Field of Classification Search ..... 160/374, 160/374.1, 375, 381; 40/482, 483, 484, 485, 40/739, 741; 101/127.1; 38/102, 102.1, 38/102.3, 102.4, 102.5, 102.6, 102.7, 102.8, 38/102.91, 102.2, 102.21, 102.9
See application file for complete search history.

(56) References Cited

U.S. PATENT DOCUMENTS

| | | | | | |
|---|---|---|---|---|---|
| 2,491,600 | A * | 12/1949 | Bearce | 160/374.1 |
| 3,625,274 | A * | 12/1971 | Johnson | 160/374.1 |
| 3,924,343 | A * | 12/1975 | Johnson | 38/102.1 |
| 3,949,802 | A * | 4/1976 | Buratovich | 160/374.1 |
| 4,023,326 | A * | 5/1977 | Azuma et al. | 52/204.56 |
| 4,144,660 | A * | 3/1979 | Lamb | 38/102.5 |
| 4,179,830 | A * | 12/1979 | Lamb | 38/102.5 |
| 4,301,853 | A * | 11/1981 | Vidal | 160/374.1 |
| 4,549,596 | A * | 10/1985 | Staro | 160/374.1 |
| 4,565,020 | A * | 1/1986 | Beatriz et al. | 38/102.5 |
| 5,040,456 | A * | 8/1991 | Hayes | 101/127.1 |
| 5,076,162 | A * | 12/1991 | Goin | 101/127.1 |
| 5,113,611 | A * | 5/1992 | Rosson | 38/102.7 |
| 5,115,584 | A * | 5/1992 | Lucchetti | 38/102.91 |
| 5,271,171 | A * | 12/1993 | Smith | 38/102.5 |
| 5,378,077 | A * | 1/1995 | Paulsen | 403/402 |
| 5,485,705 | A * | 1/1996 | Guillemet | 52/656.9 |
| 5,493,800 | A * | 2/1996 | Chinitz | 38/102.4 |
| 5,502,906 | A * | 4/1996 | Yamawaki | 38/102 |
| 5,621,994 | A * | 4/1997 | Cobb et al. | 40/782 |
| 5,722,191 | A * | 3/1998 | Morgan | 38/102.2 |
| 5,839,214 | A * | 11/1998 | Peterson | 38/102.4 |
| 6,192,628 | B1 * | 2/2001 | Pinheiro et al. | 49/70 |
| 6,253,471 | B1 * | 7/2001 | Strauh | 38/102.1 |
| 6,347,466 | B1 * | 2/2002 | Lackner et al. | 38/102.4 |
| 6,626,227 | B1 * | 9/2003 | Turner | 160/377 |
| 6,886,300 | B2 * | 5/2005 | Hudoba et al. | 52/222 |
| 2003/0136033 | A1 * | 7/2003 | Burroughs et al. | 38/102.4 |
| 2009/0020242 | A1 * | 1/2009 | Muhlebach | 160/376 |

* cited by examiner

*Primary Examiner*—Katherine W Mitchell
*Assistant Examiner*—Philip S Kwon
(74) *Attorney, Agent, or Firm*—Rosenberg, Klein & Lee

(57) ABSTRACT

A sheet material tensioning apparatus includes frame members interconnected one with another to define a closed contour. The apparatus applies tension to sheet material by imposing a separation between frame members to expand the closed contour. Beneficially, the sheet material tensioning apparatus includes an edge-bridging mechanism, such as a spline, to span the gap between the separated frame members. The edge-bridging mechanism maintains the continuity of the edge supporting the sheet material. The sheet material apparatus may include a crossbar assembly to add rigidity to long frame members, while maintaining planar alignment even under considerable compression.

9 Claims, 10 Drawing Sheets

SHEET MATERIAL TENSIONING APPARATUS

BACKGROUND OF THE INVENTION

1. Field of the Invention

The invention described herein is directed to an apparatus over which sheet material is placed to effect tensioning or stretching thereof. More specifically, the inventive concept is directed to such an apparatus that supports the sheet material in a manner that minimizes damage thereto when the sheet material is under tension.

2. Description of the Prior Art

Sheet material tensioning is practiced in a wide variety of applications. Various fabric stretcher frames have been designed to produce tension in sheet material in such fields as cargo hold coverings, silk screen printing and artist's painting canvases. Such stretcher frames generally consist of interconnected frame sections that are separated at portions of their interconnection points to expand the frame. However, as will be described in the paragraphs that follow, such expansion exposes the fabric being tensioned to planar discontinuities defined by abrupt edges that can cause deformities and weakness therein.

Referring to FIG. 1, there is shown a canvas stretcher frame typical in the prior art. The stretcher frame includes a plurality of frame sections, such as those shown at 102 and 104, interconnected at a tongue and groove mitre joint, generally shown at 110. The frame sections 102, 104 are fitted together and a pair of wedges 106, 108, sometimes referred to as "keys", are inserted into slots 112, 114, respectively, formed in the ends of the frame sections 104, 102 at the joint 110. When the frame has been assembled, a sheet of canvas (not shown) is affixed to the frame and is supported by a material-supporting lip 116 formed on the frame members 102, 104. Tension is then applied to the fabric by driving wedges 106, 108 deeper into their respective slots 112, 114. The wedging force applied by the wedges 106, 108 induces a separation between the frame members 102, 104 at the joint 110. In so doing, the planar continuity of the material-supporting lip 116 is broken to define a sharp corner, representatively shown at 118, at the joint 110. Under tension, the discontinuity of the material-supporting lip 116 introduces high stress points in the material that can produce a weakness therein, which, over time, is likely to propagate to other areas of the material. This is particularly undesirable in canvas painting surfaces where great care is taken to prepare the canvas so that the artwork disposed thereon will last for generations. Such weaknesses caused by uneven tensioning and warping of the stretched fabric are known to cause cracks in the medium, eventually necessitating usually expensive repair work.

Another stretcher frame of the prior art is illustrated in FIGS. 2A-2B, which is described in detail in U.S. Pat. No. 3,625,274. The frame includes a plurality of tubular frame sections, such as those shown at 202 and 204 interconnected by a corner insert 206. An expander element 208 is provided at the corner of the frame and an adjustment screw is threaded into the expander element 208. The adjustment screw 210 engages with an inside corner of the corner insert 206. As the screw 210 is rotated, edges of the expander element 208 engage with the ends of the frame members 202, 204 to impose a greater separation between those elements. Whereas this type of stretcher frame avoids a gap at the corner, it still exposes the fabric (not shown) to planar discontinuities in the form of abrupt edges, such as that shown at 220 in FIG. 2B.

Again, the discontinuous fabric-supporting edge introduces a deformity and a possible weakness in the material, which can become worse over time.

Given the shortcomings of the prior art, the need is apparent for a sheet material tensioning apparatus that avoids such planar discontinuities in the edges of the frame.

SUMMARY OF THE INVENTION

In one aspect of the invention, a sheet material tensioning apparatus includes a plurality of frame members interconnected to form a material-supporting edge defining a plane around a closed contour. A material fastening mechanism is provided to affix the sheet material to the frame members over the closed contour. The apparatus includes at least one expansion mechanism imposing a separation between frame members so as to expand the closed contour. An edge-bridging mechanism is provided to span the separation between each of the frame members to maintain continuity of the plane defined by the material-supporting edge at the separation as the closed contour expands.

In another aspect of the invention, a sheet material tensioning apparatus includes a plurality of frame members interconnected to form a closed contour. Each of the frame members includes a forward face and a rearward face, where the forward face has formed thereon a protrusion extending from an edge thereof along an outer periphery of the closed contour. The protrusion forms a material-supporting edge in a plane around the closed contour. A material fastening mechanism is provided to affix sheet material to the frame members over the closed contour. The apparatus includes at least one expansion mechanism imposing a separation between the frame members so as to expand the closed contour. An edge-bridging mechanism is provided to span the separation between each of the frame members to maintaining continuity of the plane defined by the material-supporting edge at the separation as the closed contour expands. A crossbar assembly extends across the closed contour and interior thereto, which includes a plurality of braces each received in a corresponding one of the frame members. The braces have a hollow interior divided by a plurality of dividing walls, where the dividing walls define a plurality of longitudinal chambers. A joining device interconnects the braces by expanding elements inserted into a corresponding one of the longitudinal chambers of said braces and an expansion actuator cooperating with the expanding elements to apply an outward force to all interior walls of the longitudinal chambers.

In yet another aspect of the invention, an artist canvas assembly includes a plurality of frame members interconnected to form a closed contour. Each of the frame members includes a forward face and a rearward face, where the forward face has formed thereon a protrusion extending from an edge thereof along an outer periphery of the closed contour. The protrusion forms a material-supporting edge to support a canvas sheet in a plane around the closed contour. A material fastening mechanism affixes the canvas sheet to said frame members. At least one expansion mechanism is provided to establish a separation between the frame members so as to apply tension to the canvas sheet and a spline bridges the separation between each of the frame members. The spline is affixed at one end thereof to one of the frame members at the protrusion thereof and affixed at an opposing end thereof to another of the frame members at the protrusion thereof. The spline thus maintains planar continuity in the canvas sheet at the separation as tension is applied thereto.

DETAILED DESCRIPTION OF PREFERRED EMBODIMENTS

The beneficial features of the present invention will be illustrated by way of a canvas stretcher frame, often referred to in the field of artistic painting as a "stretcher bar". It is to be understood that the present invention is not limited to such specific application and that numerous implementations of the present invention may be realized. The stretcher bar, however, presents an apposite example for enabling a skilled artisan to practice the inventive concept.

Figure 1:
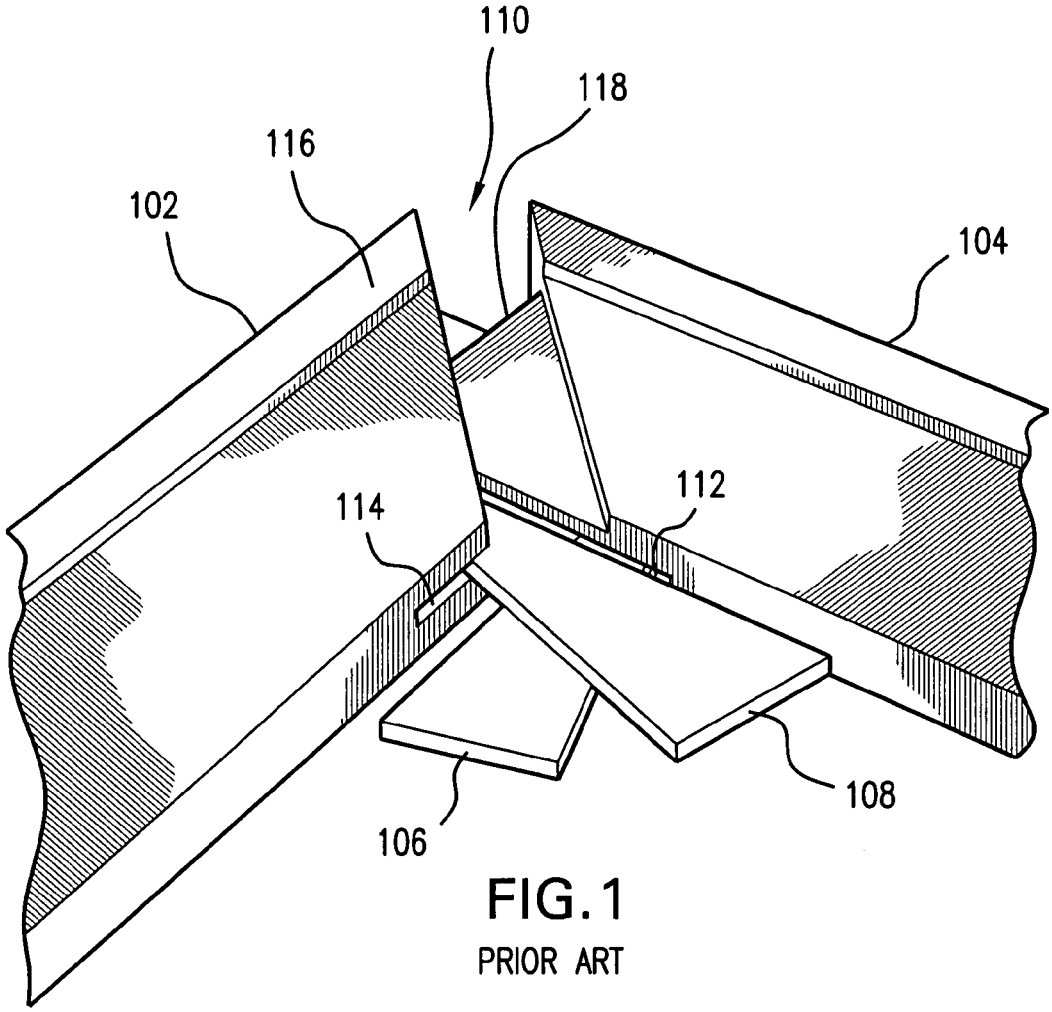
FIG. 1 PRIOR ART
FIG. 1 is an illustration of details of a material tensioning device of the prior art.
Figure 2A:
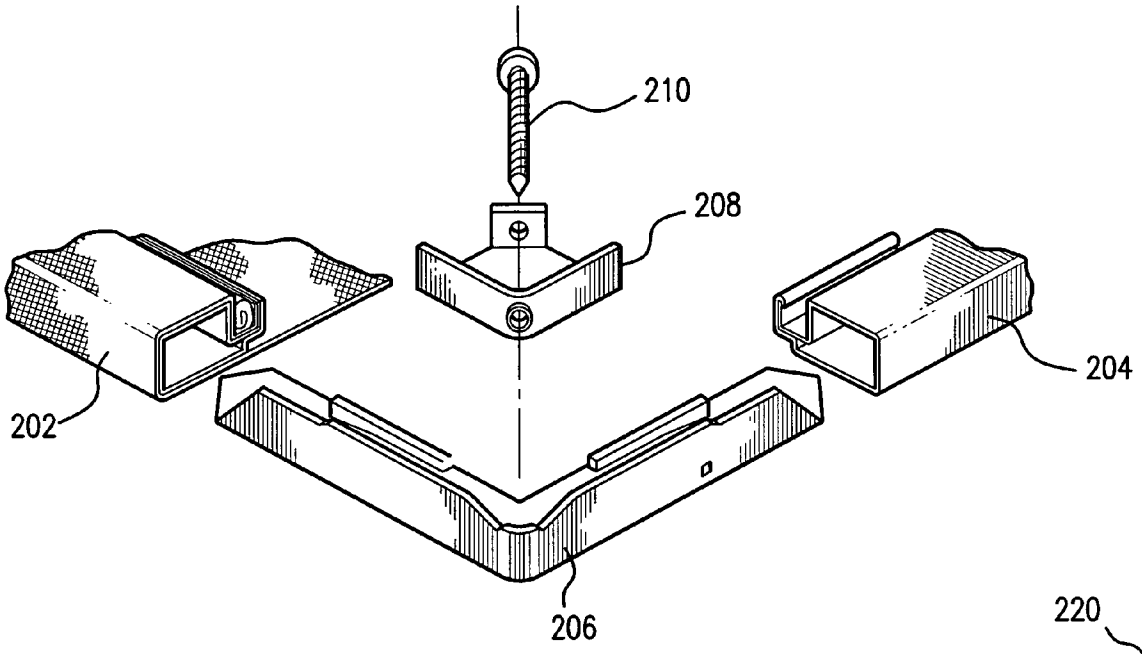
FIG. 2A PRIOR ART
FIGS. 2A-2B are illustrations of another material tensioning device of the prior art.
Figure 2B:
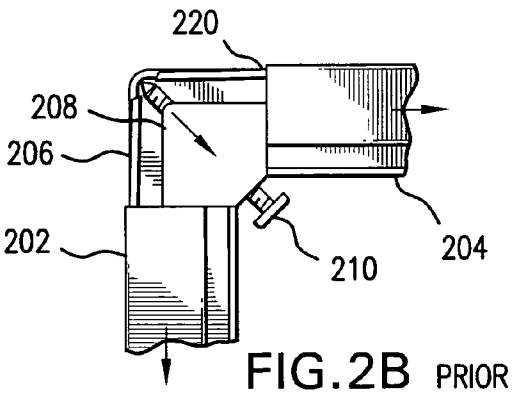
FIG. 2B PRIOR ART
Figure 3:
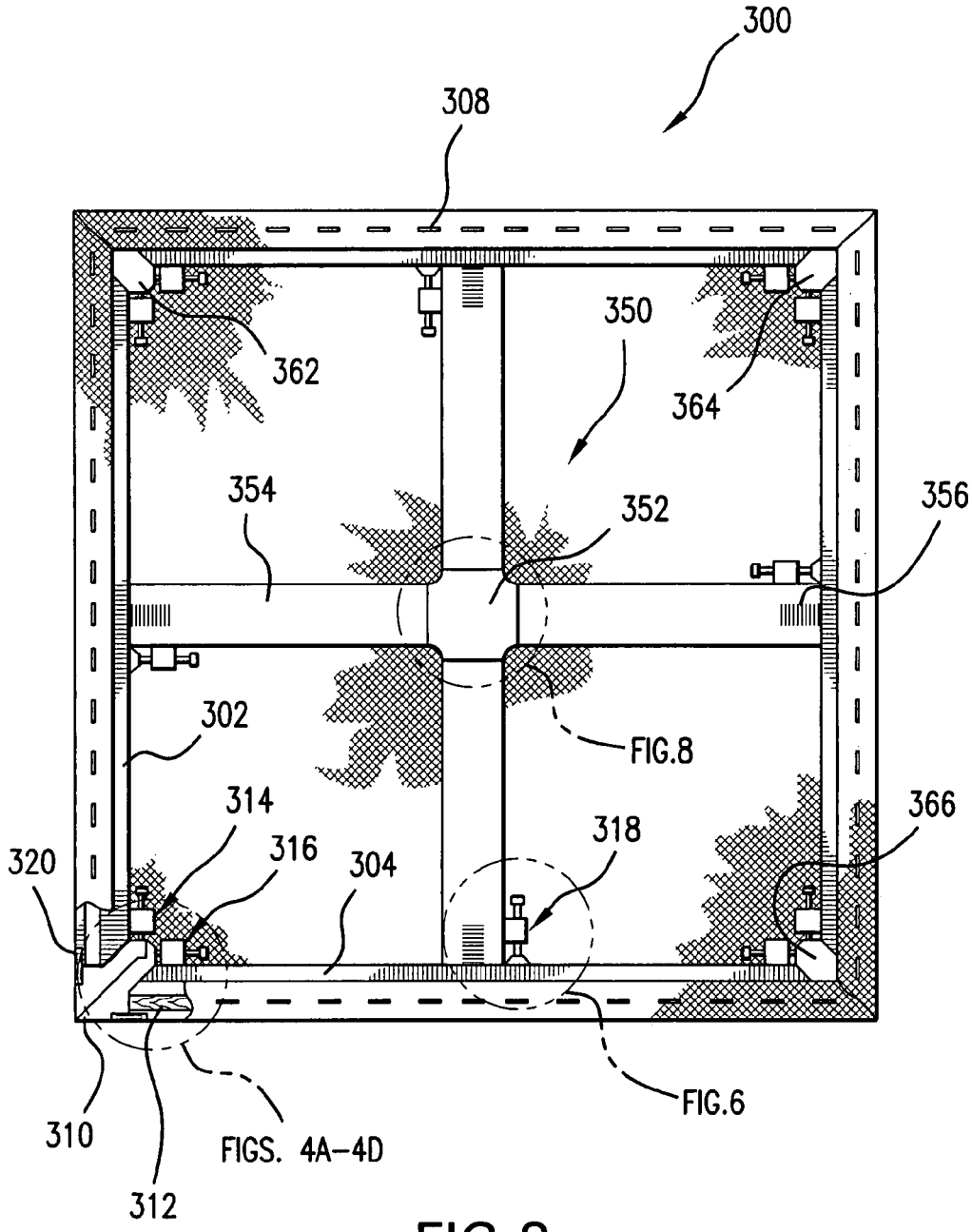
FIG. 3 is an illustration of an exemplary canvas stretcher implementing aspects of the present invention.

Referring now to FIG. 3, there is shown a rear view of the exemplary stretcher bar assembly 300 in its fully assembled form. The stretcher bar 300 may be used to apply tension to a canvas in preparation for applying paint thereto. As used herein, the term "canvas" will refer to any kind of fabric, but is typically, when used as a painting substrate, either "cotton duck" or "linen". The two fabrics are made of different kinds of plant fibers; duck, the most commonly used and least expensive type of canvas, is a white material constructed from cotton fiber. Linen, however, is much more expensive and is a light brown material made from flax fibers. In painting applications, it is essential that proper tension on the canvas be maintained to prolong the life of the painting. The support for the paint and other preparation layers is highly dependent on the rigidity created by the canvas tautness around the stretcher bar. A weakened or sagging canvas easily causes damage in aging paint layers. Such sagging can be caused by the absorption of moisture over time. Thus, as will be described in further detail below, the present invention is provided with means for tightening the canvas as required.

The exemplary stretcher bar 300 includes a plurality of frame members that include perimeter sections, such as those shown at 302 and 304, and coupling sections, such as the corner assembly 310 shown between perimeter sections 302 and 304. The stretcher bar 300 includes further an expansion mechanism, such as the adjustment mechanisms shown at 314 and 316. Stretcher bar 300 also includes a material fastening mechanism, such as the wooden strip 312 embedded into the perimeter sections 302, 304. In use, the sheet of canvas illustrated at 306 is extended across the forward face of the stretcher bar assembly 300 and is wrapped at its edges to the rearward face of the stretcher bar assembly 300. The edges of the canvas 306 are then secured at the wooden strip 312 by staples 308 or by other suitable attachment means. Once properly installed on the stretcher bar, the canvas 306 is tensioned by the adjustment mechanisms 314, 316 as well as the other adjustment mechanisms shown at the other corner assemblies 362, 364, 366. In most cases, the canvas will stretch until it maintains the desired level of tautness, at which point the canvas will be further prepared for painting.

As will be shown in more detail below, the adjustment mechanisms 314, 316 are mechanically coupled to the perimeter sections 302, 304, respectively. The distal end of a screw in each mechanism 314, 316 abuts a force block on the corner assembly 310. Rotation of the screws applies a force on the respective force block and an opposing force on the respective perimeter section 302, 304 to impose a separation between the perimeter sections 302, 304 and the corner block assembly 310.

In accordance with the present invention, the stretcher bar 300 includes a certain, if not all of its material-supporting edges an edge bridging mechanism to span the separation between the frame members 310 and 302, 304 as the closed contour of the frame expands. As used herein, a "material-supporting edge" is one at which the canvas or other material makes a directional transition when wrapped around the outer periphery of the stretcher bar 300. In certain embodiments of the invention, at least one material-supporting edge defines a plane over which the canvas is tensioned or may define a piecewise planar surface for supporting curved applications.

The edge bridging mechanism may be, for example, an edge spline, such as that shown at 320, and may be disposed at the point where the corner assembly 310 and the perimeter sections 302, 304 meet. The spline 320 bridges the separation opening and maintains planar continuity in the material-supporting edge for the canvas 306. That is to say, the edge over which the canvas is tensioned is free from abrupt transitions that would protrude into the stretched canvas. An exemplary embodiment of the spline will be described with reference to FIGS. 5A-5B and its functionality in practicing the present invention is included in the description of FIGS. 4A-D.

As is shown in FIG. 3, certain embodiments of the invention include a crossbar assembly generally shown at 350. The crossbar assembly 350 provides added rigidity to the stretcher bar 300, especially in applications where the canvas area is large. For smaller sized paintings, the crossbar assembly 350 may be omitted. The addition of the crossbar assembly is at the discretion of the artist or person responsible for preparing the canvas.

The crossbar assembly 350 includes a joining device 352 and a plurality of braces representatively illustrated at 354. Each of the braces 354 is received in an opening defined in a corresponding one of the perimeter sections, as will be described in more detail with reference to FIG. 6.

In certain embodiments of the invention, each brace 354 may have indicia disposed thereon such as the increment reference shown at 356. The increment reference 356 includes a plurality of line segments, each of which may be exposed as the brace is forced away from the corresponding perimeter section by way of actuating the adjustment mechanism 358. Other indicia for indicating reference may be disposed on the braces 354 and the scope of the invention is not limited to any particular reference indicia or mechanism.

An exemplary corner assembly 310 consistent with the present invention is illustrated in FIGS. 4A-4D. It is to be understood that the exemplary embodiment shown in FIGS. 4A-4D is provided for purposes of description and not limitation and alternative implementations are intended to fall within the scope of the present invention. Further, in FIGS. 4A-4D, and with the remaining Figures yet to be described, like reference numerals are to be understood as referring to like elements.

Figure 4A:
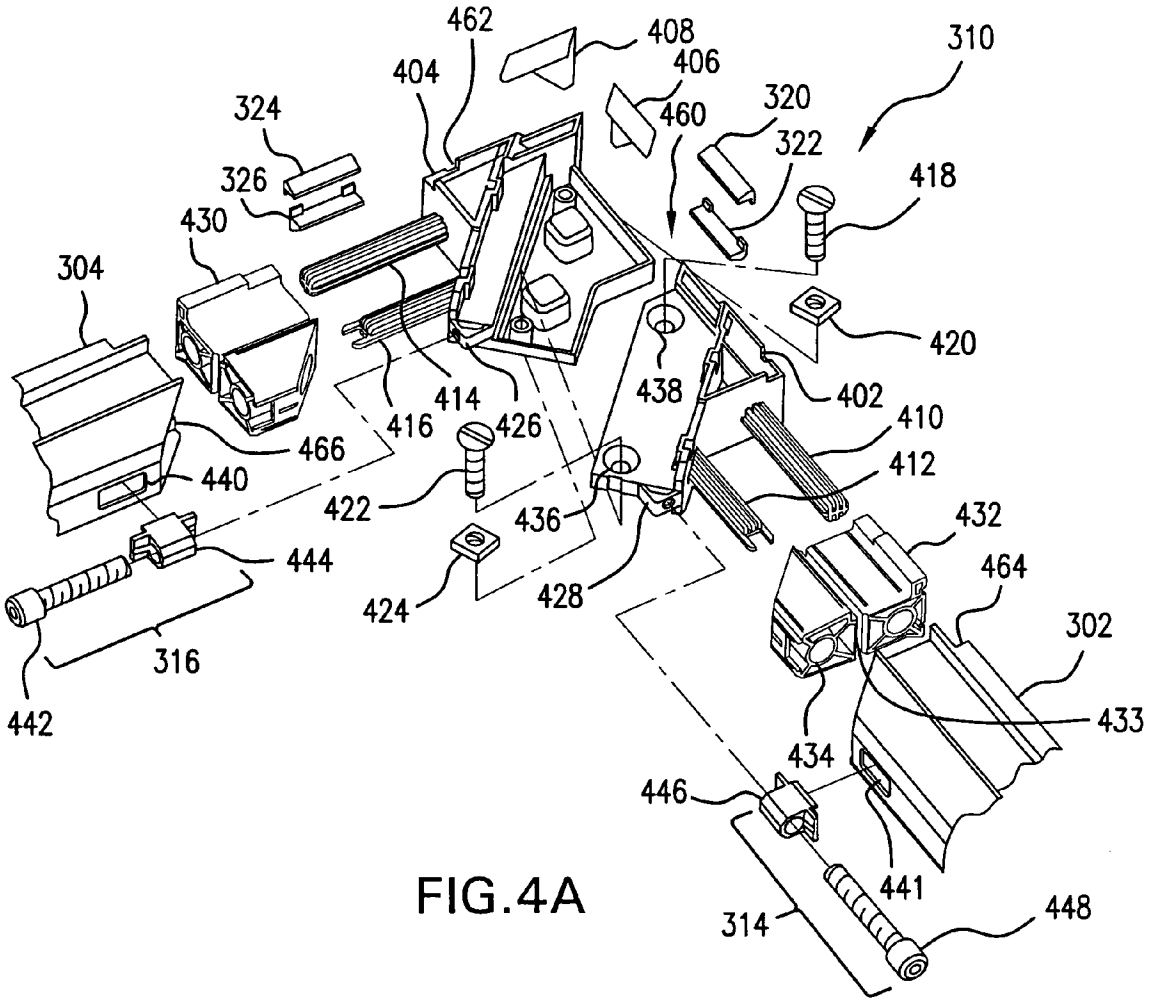
FIGS. 4A-4B are illustrations revealing details of a corner of an exemplary canvas stretcher implementing the present invention.

Referring first to FIG. 4A, there is shown an exploded rear view of an exemplary corner assembly 310. The corner assembly 310 includes a main body portion 460 which may be formed of two separate frame connectors 402, 404. The two frame connectors 402, 404 may be mechanically coupled one to another by suitable fasteners, such as the screws 418, 422 and nuts 420, 424 inserted through respective through holes 438, 436. The frame connectors 402, 404 may be manufactured from a stable material, such as molded plastic or metal. It is to be understood that the main body portion 460 may also be constructed in single piece formation as an alternative to the bisectional construction illustrated in FIG. 4A.

In the embodiment shown, the corner assembly 310 is configured to form a right angle in the closed contour of the stretcher bar 300. As such, the main body portion 460 defines a right angle corner and has coupling sections, such as dowels 410, 412, 414, 416, extending from main body portion 460 in parallel pairs, each perpendicular one pair to another. It is to be understood, however, that the coupling section between perimeter sections 302, 304 may be configured to form other polygonal closed contours and, when embodied with curved perimeter sections, elliptical closed contours are considered to fall within the scope of the present invention.

Each end of the perimeter sections 302, 304 are formed into a profile complimentary to the connecting portions of the main body portion 460, as is shown in FIG. 4A. Each end of the perimeter sections 302, 304 then receives an end plug, such as those shown at 430, 432, each of which may include a slot 433 to receive a separating wall 466 within the perimeter sections 302, 304. The separating wall 466 will be described further with reference to FIG. 7. Each end plug 430, 432 has a plurality of openings, such as that shown at 434, for receiving a respective one of the dowels 410, 412, 414, 416. It is to be understood that while the dowels 410, 412, 414, 416 and their respective openings 434 are shown to have circular cross-sectional profiles, other shapes are within the scope of the present invention.

As previously detailed, an adjustment mechanism 314, 316 may be secured to respective perimeter sections 302, 304. Each adjustment mechanism 314, 316 may include a threaded standoff 446, 444, respectively, and a corresponding adjustment screw 448, 442, respectively. The threaded standoff may be secured through a capture fit in a receiving slot 440, 441 of respective perimeter sections 304, 302. Each adjustment screw 448, 442 is threadedly inserted into the corresponding standoff 446, 444 and the distal end of the adjustment screw 448, 442 abuts a respective force block 428, 426 formed on the main body portion 460 of the corner assembly 310. In the embodiment shown in FIG. 4A, each force block 428, 426 is formed on a corresponding one of the frame connectors 402, 404. Rotation of the adjustment screw 448, 442 applies a force on corresponding force block 428, 426 and an opposing force on the corresponding perimeter section 302, 304 through the coupling arrangement between the standoff 446, 444 and its corresponding slot 440. This action imposes a separation between the perimeter sections 302, 304 and the corner block 310 to introduce tension in the canvas.

As briefly detailed above, the points of separation in the closed contour of the stretcher bar are provided with an edge bridging mechanism that spans the separation to maintain planar continuity in the material-supporting edge of the closed contour of the frame. The edge bridging mechanism may be implemented by, for example, an edge spline 320, 322, 324, 326. As will be detailed below, the splines 320, 322, 324, 326 include separate halves of complementary key/keyway pairs interstitially fit one with another. One end of the spline 320, 322, 324, 326 is received in a slot 464 formed on a corresponding perimeter section 302 and the opposing end of the spline 320, 322, 324, 326 is received in a similar slot 462 formed on a corresponding frame connector, such as that shown at 404. As the separation is formed between the perimeter section 302 and the corner block 310, the spline is extended, but the edge profile is substantially maintained on its surface by the shape of the edge-bridging spline 320, 322, 324, 326.

The corner block assembly 310 includes a pair of corner caps 406, 408 (for forming the corner treatment of the canvas at the corner).

Figure 4B:
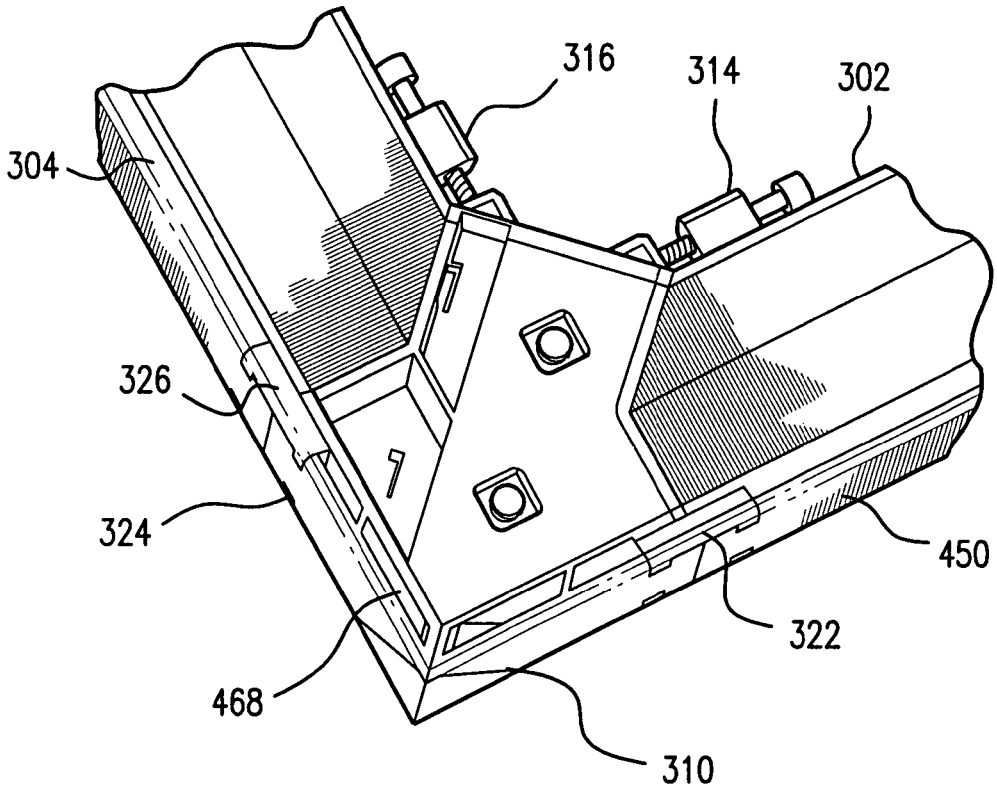

Referring now to FIG. 4B, there is shown the forward face of an assembled corner of the stretcher bar 300 in accordance with the exemplary embodiment of the present invention. As is shown, the corner block 310 has formed on its front surface a protruded material-supporting edge 468 which corresponds in profile to a protruded material-supporting edge 450 formed in each perimeter section 302, 304. Accordingly, the edge splines 322, 326 are of a cross-sectional profile to match the protrusions 450, 468 so as to maintain the profile as the frame is expanded. Similarly, the rearward facing splines, such as that shown at 324, are shaped to correspond with the rearward material supporting edge, as will be detailed further below.

Figure 4C:
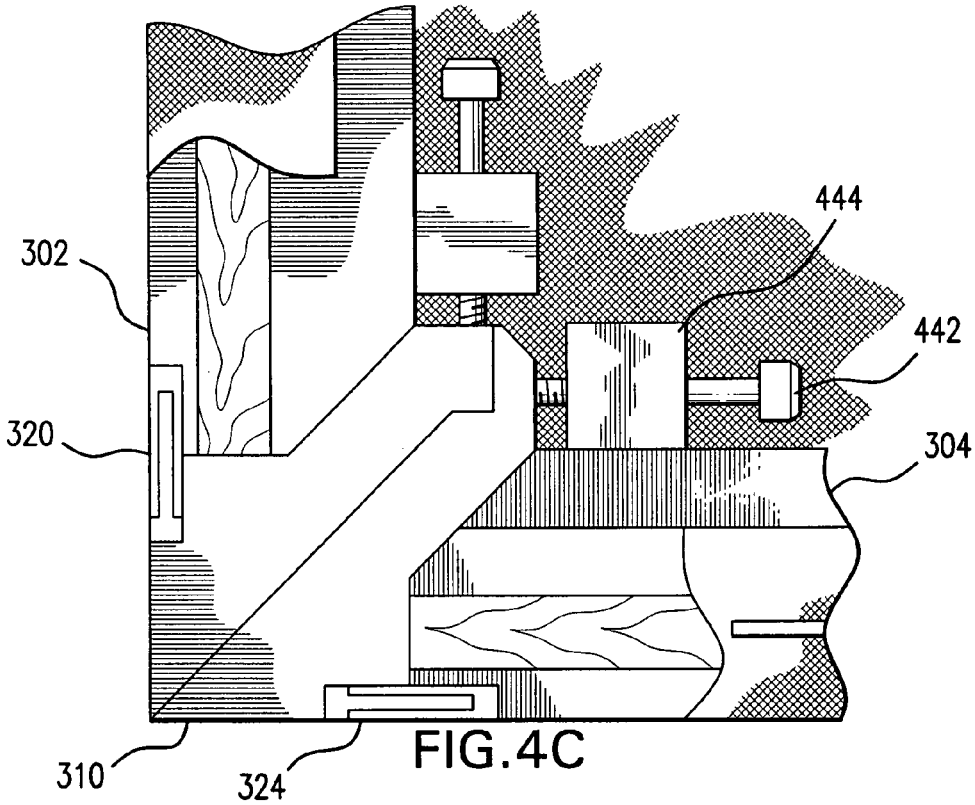
FIGS. 4C-4D are illustrations of mechanisms for expanding an exemplary canvas stretcher implementing aspects of the invention.
Figure 4D:
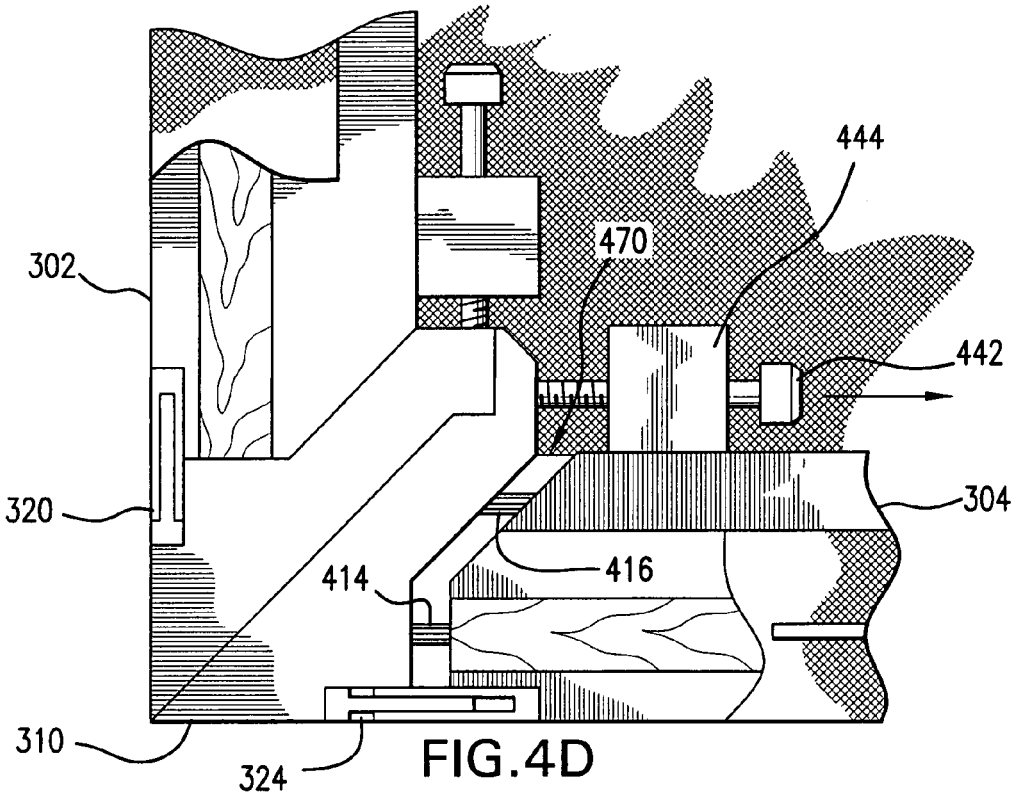

FIGS. 4C-4D further illuminate expansion of the stretcher bar assembly 300 in accordance with the present invention. FIG. 4C depicts a rearward view of the stretcher bar prior to expansion and FIG. 4D is the same view after expansion has been carried out. As is shown in the Figures, actuation of the tensioning screw 442 imposes a separation 470 between the perimeter section 304 and the corner assembly 310. Alignment of the two frame members 304, 310 is maintained by the dowels 414, 416 received in the respective end plugs as detailed above. The material supporting edges of the closed contour of the stretcher bar 300 are maintained by the interlocking keys/keyways of the splines 320, 322, 324, 326. Beneficially, such edge bridging mechanisms prevent any abrupt transition at the point of separation 470 in the stretcher bar 300. As detailed above, avoiding such transitions is believed to extend the life of the canvas and, in the artistic canvas embodiment, the life of the work disposed thereon.

Figure 5A:
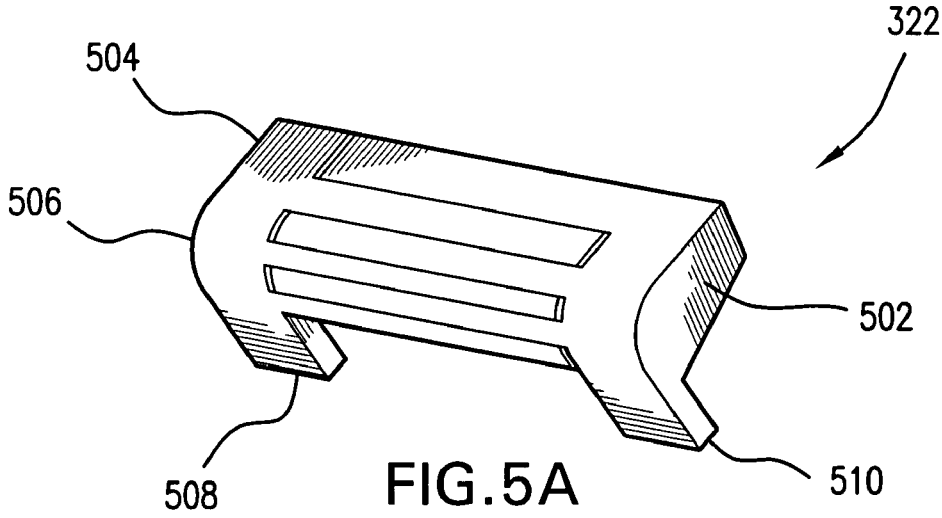
FIGS. 5A-5B are illustrations of an edge spline exemplifying aspects of the present invention.
Figure 5B:
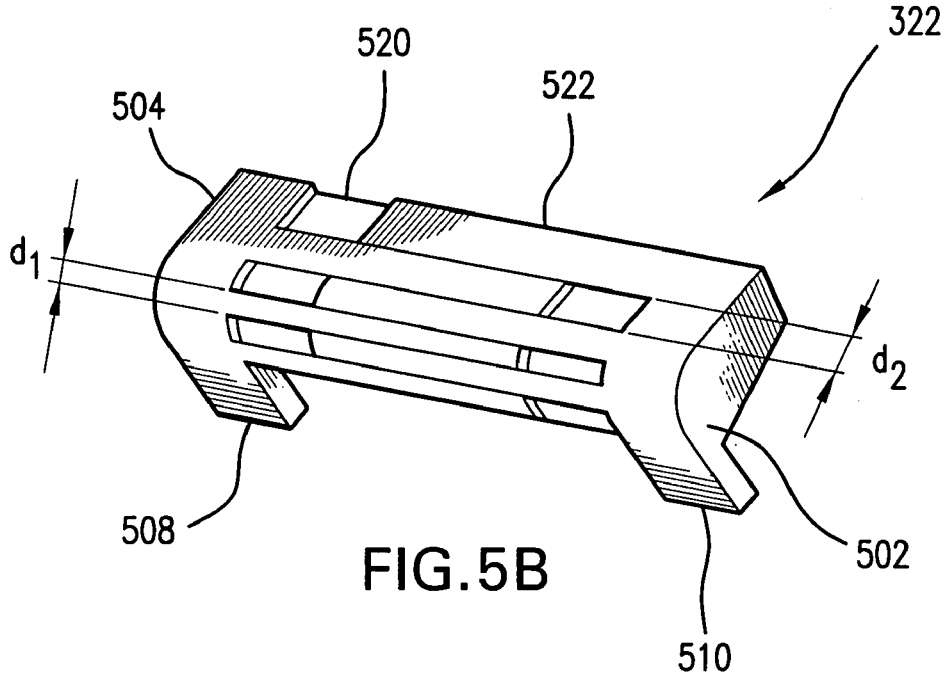

An exemplary edge spline is illustrated in FIGS. 5A-5B. As is shown in the Figure, edge spline 322 includes a first end section 502 and a complimentary end section 504, each of the two sections 502, 504 fitting one into another in an interstitial interlocking arrangement. Each section 502, 504 includes a plurality of keys, representatively illustrated at 522, and a complimentary keyway, representatively illustrated at 520. It is to be understood that while the keys 522 and keyways 520 in FIG. 5B are shown as interfitting only on a surface portion of the spline 322, both keys 522 and keyways 520 may be formed to extend through the body of the spline 322. The keys and keyways may be of varying dimensions, for example $d_1$ and $d_2$ or may be of equal dimensions on the body of the spline 322.

The exemplary spline 322 includes a pair of tabs 508, 510 to be received respectively in slots formed on the corner assembly 310 and a corresponding perimeter section, for example 302. The tabs 508, 510 fit into corresponding slots so as to extend as the separation between the corner block 310 and the perimeter section 302 increases. As previously detailed, the spline 322 may have a cross-sectional profile that substantially matches the corresponding material-supporting edge in which it is placed. The spline 322 may be manufactured from a suitably stable material that allows some flexibility in the spline keys 522 and keyways 520, such as plastic. Moreover, it is to be understood that the spline may be formed along its length to accommodate other shapes. For example, the spline may be curved to match an oval closed contour of a tensioning apparatus. Additionally, other edge bridging mechanisms may be used in accordance with the present invention without deviating from the intended scope thereof.

Figure 6:
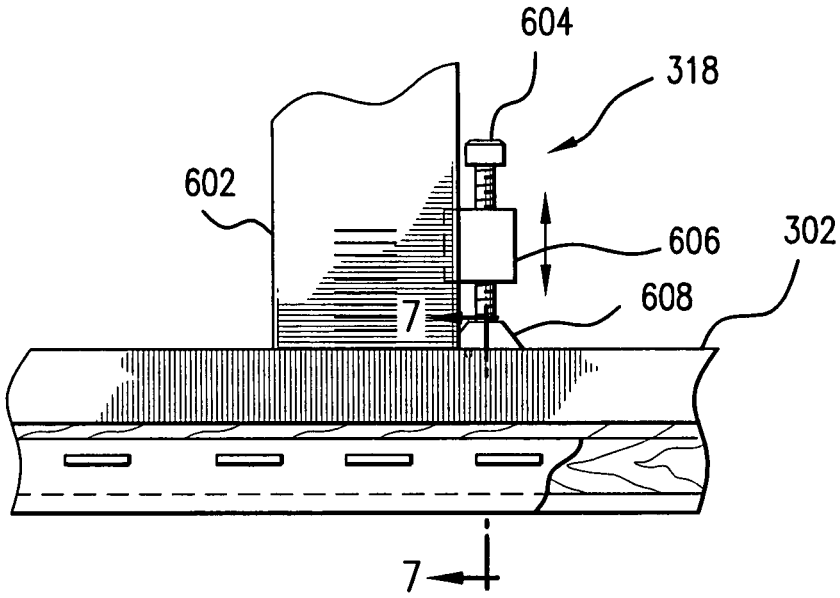
FIG. 6 is an illustration of an exemplary crossbar expansion mechanism operable in accordance with the present invention.

Referring now to FIG. 6, there is shown a detailed view of the perimeter section 302 fitted with a crossbar brace 602. As is shown in FIG. 6, each brace 354 may include a corresponding adjustment mechanism 318 for applying outward force to the closed contour of the stretcher bar 300. Such outward force may compensate for bowing frame members and may be used to ensure even tension across the surface of the canvas 306. Each adjustment mechanism 318 may include a threaded standoff 606 and a tensioning screw 604. Rather than applying force directed to the perimeter section itself, certain embodiments of the invention provide a force spreading block, such as that shown at 608 to disburse the force applied by the tensioning screw 604 of screw mechanism 318. Such a force spreading block may be in the form of a truncated pyramid having a flattened top for receiving the distal end of the screw 604.

Figure 7:
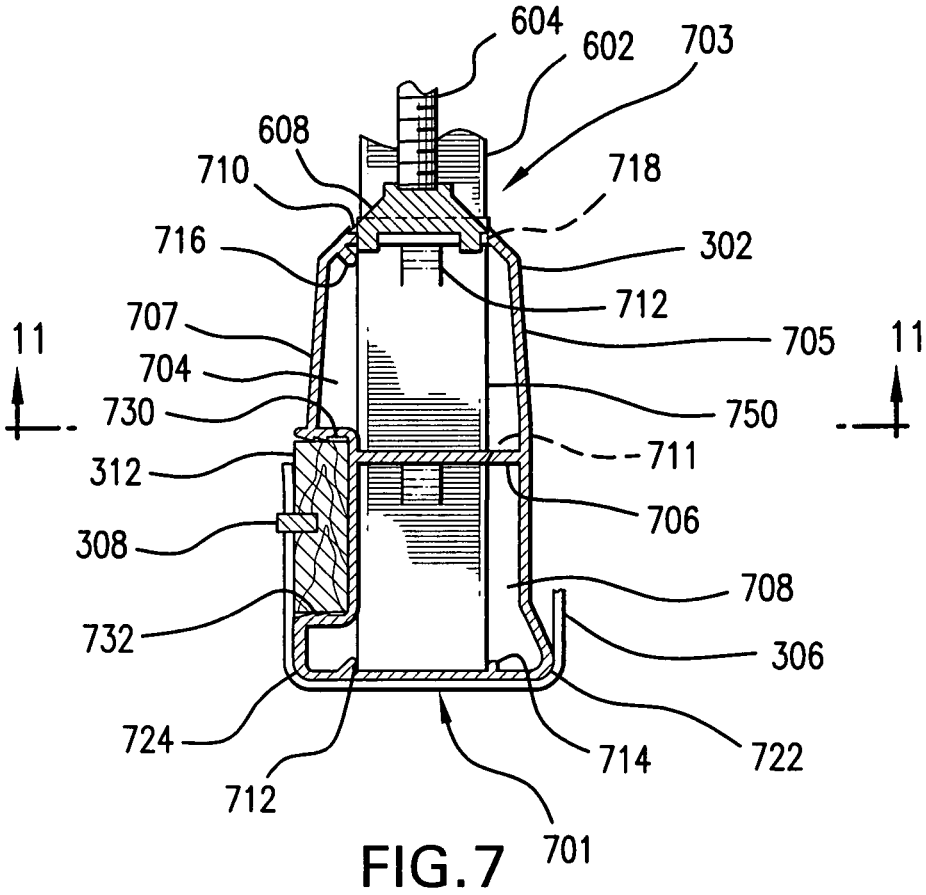
FIG. 7 is an illustration of an exemplary cross-sectional profile of an exemplary perimeter section consistent with the present invention.

A cross-sectional view of an exemplary perimeter section 302 is illustrated in FIG. 7. As is shown FIG. 7, the exemplary perimeter section 302 is substantially tubular with a predefined polygonal cross-sectional profile. In certain embodiments of the invention, the profile is formed by an extrusion process and may be composed of aluminum or other suitably sturdy material.

As previously detailed, the perimeter sections form a closed contour around the stretcher bar and have accordingly an outer peripheral surface 701 and an inner peripheral surface 703. The perimeter section 302 further includes a forward face 705 over which the canvas 306 extends, and a rearward face 707, on which the canvas 306 is attached. The edges of the outer peripheral surface 701 form material-supporting edges 722, 724. The material-supporting edge 722 of the forward face 705 may be formed by a protrusion so that the canvas 306 maintains physical separation from the forward face 705 of the perimeter section 302. Whereas such configuration is preferable in high quality stretcher bars, the forward material-supporting edge 722 may also be formed at a right angle to the forward face 705, such as shown at the rearward material-supporting edge 724. Other protrusion shapes for forming the material-supporting edge 722 are possible and such variations are intended to fall within the scope of the present invention.

As is shown in FIGS. 6 and 7, the perimeter section 302 is substantially hollow and may include an interior wall 706 to define two longitudinal chambers 704 and 708. The separating wall 706 may provide additional rigidity to the perimeter section 302 and provides supporting cavities to receive the corner assembly 310 as well as to provide a surface against which the brace receiving insert 750 may be captured, as will be detailed in the paragraphs that follow.

To provide a stable mating cavity for the brace 602, certain embodiments of the invention provide a sleeve insert 750 to be perpendicularly set into the perimeter section 302. The perimeter section 302 has formed in the interior periphery surface 703 an opening 718 and a similar opening 711 is formed in the separating wall 706. A tubular sleeve insert 750 is inserted into openings 718, 711. The surface of chamber 708 interior to the outer periphery surface 701 has formed thereon a receiving channel defined by longitudinal protrusions 712, 714. The interior peripheral surface 703 has formed thereon a channel 710 extending along its length and the end of the insert 750 may extend at least to the defining walls of the channel 710. The surface of chamber 704 interior to the interior peripheral surface 703 has formed thereon a protrusion 716. Thus, by way of the protrusions 712, 714, 716, the insert 750 is prevented from any lateral movement as the forces are applied to the stretcher bar 300. This ensures a stable support system for longer perimeter sections as used in larger pieces of artwork. To prevent longitudinal motion, the sleeve 750 is captured in place by the interior wall of the interior peripheral surface 703 and the dividing wall 706 interior to chamber 708 by means of capturing formations 712. Such formations may be formed by, for example, swedging. As is known in the art, "swedging" refers to a process by which an outer diameter of a tubular structure is expanded to be withheld by the inner diameter of another tubular structure, such as that defined by cavities 718 and 711.

Figure 11:
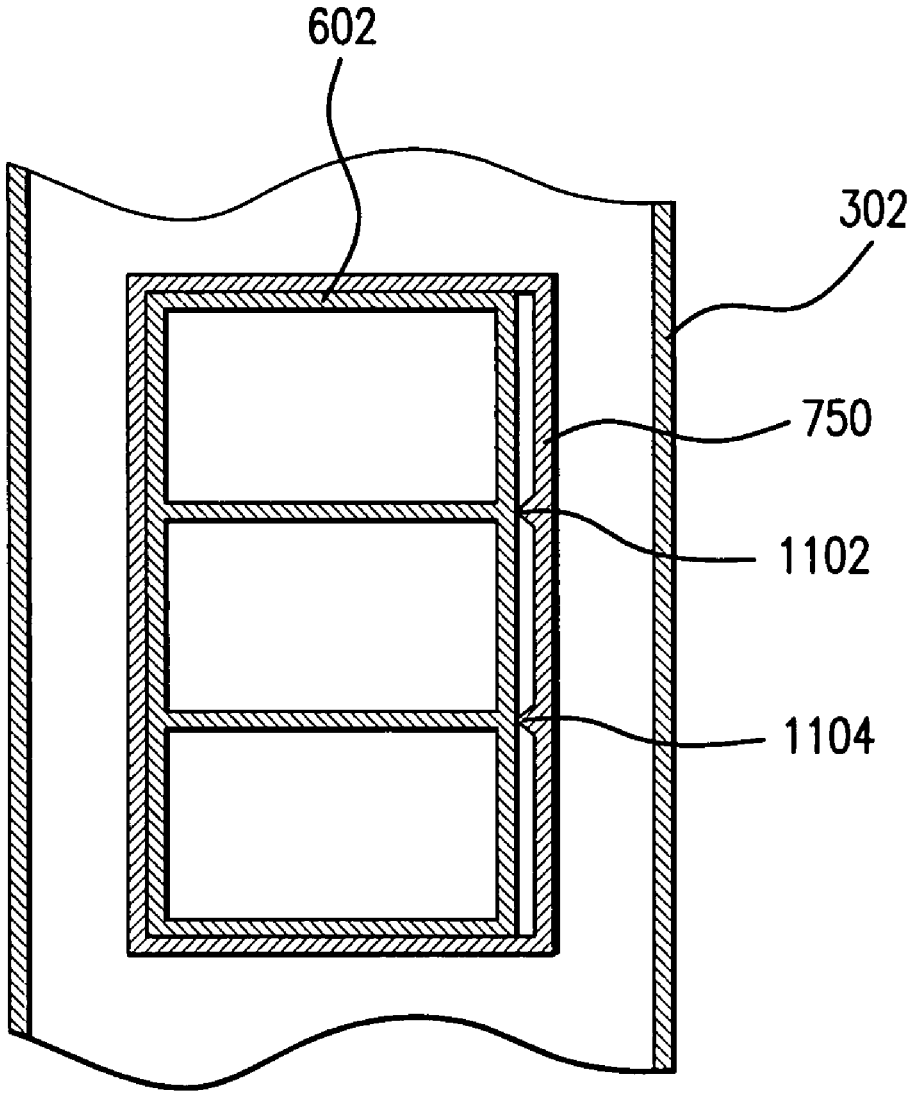
FIG. 11 is a cross-sectional view of an exemplary sleeve insert for supporting a cross-bar assembly in accordance with aspects of the present invention.

As is shown in FIG. 11, the insert 750 may have on an interior wall thereof a plurality of longitudinal protrusions 1102, 1104 for increasing the frictional force between the insert 750 and the brace 602. Such increased frictional force ensures that the brace remains in alignment with other braces as the crossbar assembly 350 undergoes compression by the tensioning of the canvas 306.

Returning now to FIG. 7, it is shown that the exemplary perimeter section 302 may include an insert channel 730 for receiving a fastening strip, such as the wooden strip 312 illustrated in FIG. 7. To ensure that the fastening strip 312 is retained in the channel 730, the interior walls of the channel 730 may include a number of longitudinal serrations 732, which are formed in a direction that allows easy insertion of the fastening strip 312 and opposes its removal.

Figure 8:
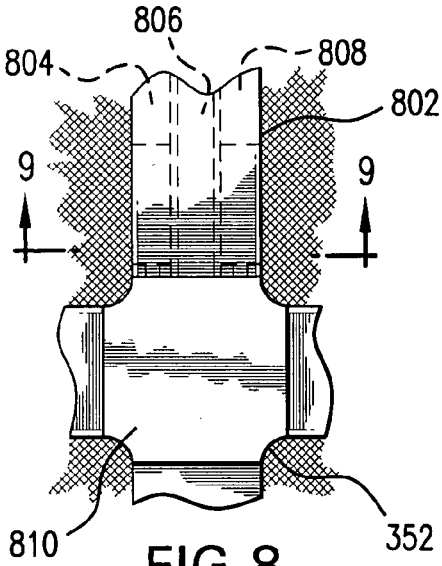
FIG. 8 is an illustration of an exemplary crossbar assembly implementing aspects of the present invention.

Referring now to FIG. 8, there is shown details of a crossbar assembly consistent with aspects of the present invention. Although many implementations for the crossbar assembly 350 are possible, the considerable compression force thereon should be considered. For example, lapped dado arrangements of the prior art are prone to breaking under the force created by the compression of the expanded canvas. Moreover, such lapped dado arrangements may separate when bowing in the crossbar members occurs. In such instances where the members do break or separate, damage may be caused by a brace member jutting into the canvas.

Figure 9:
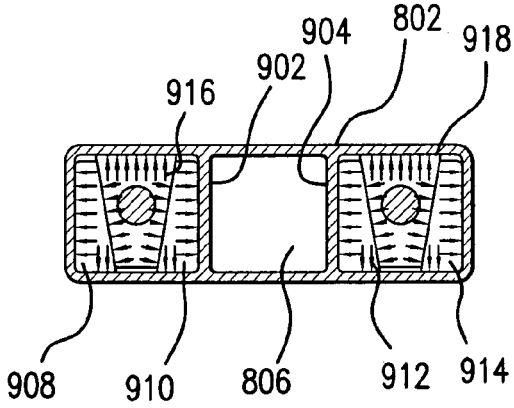
FIG. 9 is an illustration revealing details of a crossbar assembly joining device implementing aspects of the present invention.

To prevent such damage, the present invention implements a crossbar assembly that maintains planar alignment of its constituent elements even under considerable compression. As is shown in FIG. 8, the crossbar joining device 352 is received into longitudinal chambers 804, 808 formed in the brace member 802. A third longitudinal chamber 806 may remain empty or may have a further joining mechanism received therein. As is shown in FIG. 9, the longitudinal chambers 804, 806, 808 are defined by two longitudinal dividing walls 902, 904. The joining device 352 has extending from a center body portion 810 a plurality of expanding members 908, 910 and 912, 914. Between each pair of expanding members 908, 910 and 912, 914 is received a corresponding expansion actuator 916, 918, respectively.

Figure 10:
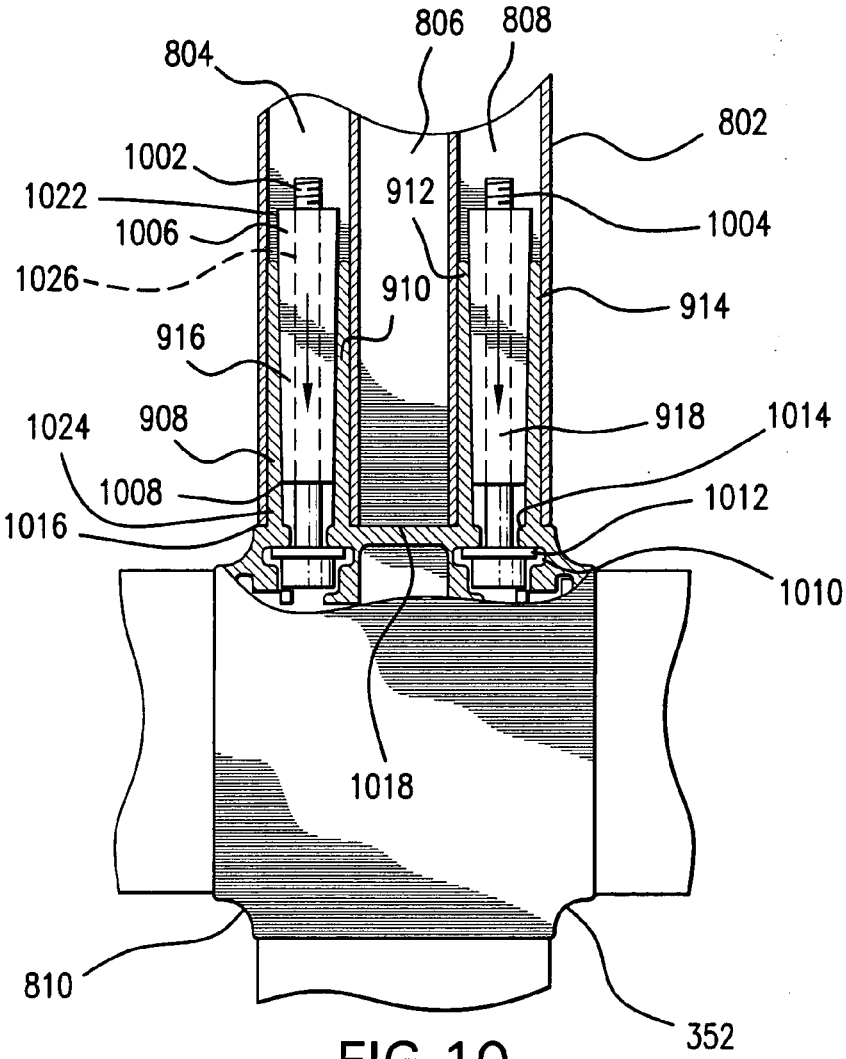
FIG. 10 is a cross-sectional view of an exemplary crossbar assembly joining device implementing certain aspects of the present invention.

Turning momentarily to FIG. 10, it is shown that the expanding actuator 916, 918 is formed in a wedge shape, where one end 1006 is of greater lateral extent than the opposing end 1008. Additionally, the expanding members 908, 910 and 912, 914 are also formed in a wedge shape where the distal end 1022 thereof is of a lesser lateral extent than the proximal end 1024 thereof. The expansion actuator 916, 918 has formed therein a threaded through hole 1026, 1028 in which is threadedly received a respective actuator screw 1002, 1004. The actuator screw is captured at its head by a shoulder, such is formed by a washer 1012, received in semicircular or circumferential slot, such as that shown at 1010. The brace member 802 is placed onto the coupling device 352 and is inserted to abut a shoulder 1016 at its outer periphery and an abutment wall 1018 at the terminus of longitudinal chamber 806. As the actuator screw 1002, 1004 is rotated, the expansion actuator 916, 918 is drawn interstitially into the corresponding expansion members 908, 910 and 912, 914. By this action, the expansion members further separate to cause an increased frictional force against the interior walls of the longitudinal chambers 804, 808. Additionally, as is shown in FIG. 9, as the expansion actuator 916, 918 is forced further towards the main body portion 810 of the joining device 352, it is forced upwards to engage an interior wall of each of the chambers. Moreover, the expansion members 908, 910 and 912, 914 are forced downwards by the expansion actuators 916, 918 to engage in the wall opposite the wall frictionally engaged with the actuating members 916, 918. Beneficially, all interior walls of longitudinal chambers 804, 808 are tightly engaged with the joining mechanism 352. This prevents the crossbar assembly 350 from bowing under the compression exerted thereon.

The descriptions above are intended to illustrate possible implementations of the present invention and are not restrictive. Many variations, modifications and alternatives will become apparent to the skilled artisan upon review of this disclosure. For example, components equivalent to those shown and detailed may be substituted therefore, elements individually detailed may be combined, and elements detailed as discrete may be distributed across many components. The scope of the invention should therefore be determined not with reference to the description above, but with reference to the appended Claims, along with their full range of equivalents.

What is claimed is:

1. A sheet material tensioning apparatus comprising:

a plurality of frame members interconnected to form a material-supporting edge defining a plane around a closed contour;

a material fastening mechanism for affixing sheet material to said frame members over said closed contour;

at least one expansion mechanism imposing a separation between said frame members so as to expand said closed contour;

an edge-bridging mechanism spanning said separation between each of said frame members and maintaining continuity of said plane defined by said material-supporting edge at said separation as said closed contour expands; and wherein said edge-bridging mechanism is a spline affixed at one end thereof to one of said frame members at a first respective protrusion thereof and affixed at an opposing end thereof to another of said frame members at a second respective protrusion thereof, said spline having a pair of complementary spline sections, each of said spline sections having a plurality of keys received into keyways of said other complementary one of said spline sections to form a cross-sectional profile matching said first and second respective protrusions in said frame members.

2. The sheet material tensioning apparatus as recited in claim 1, wherein said frame members include:

a plurality of perimeter sections; and a plurality of coupling sections interconnecting said perimeter sections one to another so as to form said closed contour, wherein said separation between said frame members is between one of said coupling sections and said perimeter sections interconnected thereby.

3. The sheet material tensioning apparatus as recited in claim 2, wherein said perimeter sections are of hollow elongated construction having a polygonal cross-sectional profile and said coupling sections include a body portion and a plurality of coupling portions extending from said body portion, said coupling portions being received into an end of a corresponding one of said perimeter sections.

4. The sheet material tensioning apparatus as recited in claim 3, wherein each of said perimeter sections have an interior wall defining therein separate elongated chambers, said perimeter sections including a plug in each end thereof defining an opening in each of said chambers at said end, said coupling portions of said coupling sections including a pair of extending members each having a cross-sectional profile complementary to said opening in said plug and received therein.

5. The sheet material tensioning apparatus as recited in claim 2, wherein said coupling sections include a corner in a body portion thereon, said corner having a corner cap disposed on an outer periphery of said closed profile.

6. The sheet material tensioning apparatus as recited in claim 1, wherein each of said frame members includes a forward face and a rearward face, said forward face having formed thereon said first and second respective protrusions extending from an edge thereof along an outer periphery of said closed contour, said protrusions forming said material-supporting edge.

7. The sheet material tensioning apparatus as recited in claim 6 further including a second spline on said rearward face of said frame members in opposing spatial relationship with said spline on said forward face, said second spline having a pair of complementary spline sections, each of said spline sections having a plurality of keys received into keyways of said complementary one of said spline sections to form a cross-sectional profile matching a rearward edge of said frame members.

8. The sheet material tensioning apparatus as recited in claim 2, wherein said expansion mechanism includes:

a standoff disposed on each of said perimeter sections, said standoff having formed therein a threaded through hole;

an adjustment screw threadedly engaged in said threaded through hole; and a force block formed on each of said coupling sections and in abutment with a distal end of said adjustment screw such that rotation of said adjustment screw applies a force to said force block and an opposite force on said standoff to impose said separation.

9. The sheet material tensioning apparatus as recited in claim 1 further including a crossbar assembly interior to said closed profile, said crossbar assembly including braces interconnected to span opposing pairs of said frame members, said braces received in cavities formed in said frame members and including an adjustment mechanism applying selectable tensioning force to said frame members.

* * * * *